US006755877B2

(12) United States Patent
Perlman

(10) Patent No.: US 6,755,877 B2
(45) Date of Patent: Jun. 29, 2004

(54) FREESTANDING PLASTIC CONTAINER FOR CONTROLLED COMBUSTION OF ALCOHOL-BASED LIGHTER FLUID

(75) Inventor: Daniel Perlman, Arlington, MA (US)

(73) Assignee: Brandeis University, Waltham, MA (US)

( * ) Notice: Subject to any disclaimer, the term of this patent is extended or adjusted under 35 U.S.C. 154(b) by 16 days.

(21) Appl. No.: 10/010,689

(22) Filed: Nov. 8, 2001

(65) Prior Publication Data

US 2003/0087212 A1 May 8, 2003

(51) Int. Cl.[7] ..... C10L 11/00
(52) U.S. Cl. ..... 44/534; 44/451; 44/452
(58) Field of Search ..... 44/266, 451, 534, 44/452

(56) References Cited

U.S. PATENT DOCUMENTS

| | | | | |
|---|---|---|---|---|
| 1,545,595 A | | 7/1925 | Mork | 44/266 |
| 2,838,384 A | | 6/1958 | Sloan et al. | |
| 3,779,693 A | | 12/1973 | McKenney et al. | |
| 3,801,292 A | | 4/1974 | Tanner | |
| 4,156,594 A | | 5/1979 | Tarpley, Jr. | |
| 4,157,242 A | | 6/1979 | Tarpley, Jr. | 44/268 |
| 4,165,968 A | | 8/1979 | Duncan | |
| 4,238,201 A | | 12/1980 | Spilles | |
| 4,365,971 A | | 12/1982 | Monick | |
| 4,436,525 A | | 3/1984 | Zmoda et al. | 44/266 |
| 4,786,290 A | | 11/1988 | Wyer | |
| 5,143,045 A | | 9/1992 | Minnis | |
| 5,226,405 A | | 7/1993 | Snow | |
| 5,641,890 A | | 6/1997 | Wesley et al. | |
| 5,797,509 A | | 8/1998 | Fitch | 220/258.2 |
| 5,858,031 A | * | 1/1999 | Perlman | 44/452 |

FOREIGN PATENT DOCUMENTS

| | | |
|---|---|---|
| BR | 9002455 | 11/1991 |
| GB | 2281915 | 3/1995 |
| JP | 620594 | 1/1987 |

OTHER PUBLICATIONS http://www.cvs.com/CVSApp/cvs/gateway/detail?prodid=149450&previousURI=/CVSApp/cvs/gateway/search?ActiveCat=499λQuery=isopropyl+alcoholλGo.x=12Go.y=13.

* cited by examiner

*Primary Examiner*—Cephia D. Toomer
(74) *Attorney, Agent, or Firm*—Mark P. White

(57) ABSTRACT

A combustible fire-starting or heat-providing assembly is described that includes a suitable quantity of combustible alcohol-based fuel liquid held within a freestanding, combustible, alcohol-resistant and alcohol-impermeable container. The container is configured with at least a bottom wall and a perimeter sidewall that is continuous with the bottom wall, in which the upper portion of the container is substantially open to the air to allow free-burning of the fuel liquid. The container is of a suitable composition and the sidewall is of an adequate thickness and rigidity for the container to retain the fuel liquid without leakage throughout the period of combustion of the fuel, even as the sidewall gradually diminishes in height as it melts and burns downward toward the bottom wall of the container.

35 Claims, No Drawings

FREESTANDING PLASTIC CONTAINER FOR CONTROLLED COMBUSTION OF ALCOHOL-BASED LIGHTER FLUID

BACKGROUND OF THE INVENTION

This invention relates to the use of certain combustible, freestanding thermoplastic containers rather than metal canisters, plastic pouches and other devices for both the packaging and controlled burning of alcohol-based fluids, without fuel leakage occurring even as these thermoplastic containers gradually melt and burn.

Ethyl alcohol, a non-polluting, combustible, and renewable energy source, has become an increasingly popular fuel which is commercially sold for use in alcohol stoves, for example. Ethanol is also used in combination with other fuels such as gasoline to produce "gasohol". Mixed alcohol fuels have also been described. For example, isopropanol has been combined with ethanol. Besides serving as a denaturing agent, the isopropanol provides flame coloration as described by Perlnan in U.S. Pat. No. 5,858,031 for safety purposes, e.g., skin burn prevention. Some alcohol-containing fuels have been used as lighter fluids for igniting solid fuels such as barbecue charcoal and wooden logs. Alcohol-based fuels may be "free-burned", i.e., a pre-measured quantity of fuel is burned in the open air without the use of a stove or other hardware device to regulate combustion. With the free-burning of lower alcohols, the rate of combustion and flame spread can be controlled by a combination of water dilution and addition of thickening agent, e.g., hydroxypropylcellulose or polyacrylate.

A gelled alcohol-based fuel known as Sterno® (manufactured by Colgate-Palmolive, Tenafly, N.J.) contains approximately 65–70% by volume ethanol, and is packaged and burned in metal cans which can be placed under food vessels such as chafing dishes. The metal can is generally discarded as a waste product after the alcohol gel is burned.

Snow, U.S. Pat. No. 5,226,405 describes an auxiliary fuel source which is placed beneath charcoal in a grill for the purpose of igniting the charcoal. Similarly, McKenney et al., U.S. Pat. No. 3,779,693 describe a charcoal igniting device employing a fuel source positioned beneath the charcoal. Similarly, Minnis, U.S. Pat. No. 5,143,045 describes an apparatus and method for igniting briquettes in a cooking utensil by placing a solid flammable fire-starting material in an enclosure beneath the briquettes.

Sloan et al., U.S. Pat. No. 2,838,384 describe a combustible alcohol and finely divided charcoal-containing mixed gel composition which is intended to cling or adhere to charcoal or wood materials, for igniting these materials.

Duncan, U.S. Pat. No. 4,165,968, describes a rapidly ignitable charcoal briquette with a thickened flammable alcohol-containing coating applied to the briquette.

Tanner, U.S. Pat. No. 3,801,292 describes a fire starting composition in gelled form which solidifies upon ignition.

Tarpley, Jr., U.S. Pat. Nos. 4,156,594 and 4,157,242 and Wesley et al., U.S. Pat. No. 5,641,890 describe thixotropic gel fuels.

Monick, U.S. Pat. No. 4,365,971 describes an alcohol-based fuel gel composition for igniting wood or charcoal in which the composition is packaged in a pressurized container and dispensed onto the surface of the wood or charcoal.

Spilles, U.S. Pat. No. 4,238,201 describes a pasty emulsion of an alcohol for lighting charcoal in which a sealed polyethylene-coated cellophane foil bag is used to hold the pasty emulsion. This flexible bag (formed from a film approximately 0.004 inches thick) is reported to burn away entirely, exposing the fuel, unless the thickness of the bag becomes too great, in which case the bag becomes fire-inhibiting.

Wyer, U.S. Pat. No. 4,786,290 describes a burnable charcoal package that includes an elongated plastic container in the form of a conventional side edge-sealed pouch filled with an alcohol gel. An elongated fuse along the pouch's length is required to initially burn, thereby melting through the pouch and igniting the gel, which then ignites the charcoal.

Solidified alcohol-based fuels, coatings of liquid or solid fuels on charcoal and wood, and liquid fuels packaged in non-combustible containers, do not tend to leak from barbecue grills. On the other hand, any of the above-described liquid alcohol-based fuels placed either free in the bottom of a barbecue grill or packaged inside a thin-walled pouch may, as it burns, leak out of the grill through ventilation holes or cracks in the grill bottom. For example, Applicant has packaged liquid alcohol fuels described in the present invention inside plastic pouches such as those described by Spilles and by Wyer, and it was found that these pouches leaked when burned. As stated above, if a burning fuel liquid is allowed to leak from a grill, it may cause an accidental fire. The present invention reduces or eliminates this risk.

SUMMARY OF THE INVENTION

This invention concerns the use of a combustible fire-starting (or generally heat-providing) assembly that includes a suitable quantity of combustible alcohol-based fuel liquid contained within a freestanding, alcohol-resistant and impermeable, and combustible container preferably a thermoplastic container. The container is suitably sized (to hold the quantity of fuel liquid), and has a bottom wall and a perimeter sidewall that is continuous with (joined to) the bottom wall. Unlike a pouch, the container is freestanding and in use its upper portion is open to the air to allow free-burning of the fuel liquid. Surprisingly, by selecting an open style container having a suitable composition, and having a sidewall of an adequate thickness, the container is able to retain the alcohol-based fuel without leaking, throughout the period of combustion of the fuel liquid. Even as the container's sidewall gradually becomes shortened in height as it melts and burns downward along with the fuel, the container retains the fuel. This fire-starting assembly can be used for igniting a charcoal or wood fire, but can also be used as a heat source, e.g., for warming or cooking food.

Thus in a first aspect, the invention features a combustible fire-starting or heat-providing assembly that includes a suitable quantity of combustible alcohol-based fuel liquid within a freestanding combustible alcohol-resistant and alcohol-impermeable semi-rigid container. The container is sized to hold that quantity of liquid, and is configured with at least a bottom wall and a perimeter sidewall that is continuous with the bottom wall. In use, the upper portion of the container is substantially open to the air to allow free-burning of the fuel liquid. The container is of a suitable composition, and its sidewall is of an adequate thickness to allow the container to retain the fuel liquid without leakage throughout the period of the fuel's combustion, even as the sidewall gradually diminishes in height as it melts and burns downward toward the bottom wall of the container.

In preferred embodiments, the fuel liquid and the container constituting the assembly are composed of materials consisting essentially of carbon, hydrogen and oxygen atoms which, upon combustion, produce water and carbon dioxide. Highly preferably, the assembly is substantially free of chlorinated, or other halogenated, compounds which, upon burning, may produce dioxin or other toxic substances. In particular, the container (or at least all portions of the container that will be burned) are substantially free of halogenated, e.g., chlorinated, compounds. Also preferably, the container is substantially free of heavy metals.

In preferred embodiments, the assembly meets California and/or Federal Volatile Organic Compounds (VOC) emission standards for charcoal lighter material products. Preferably the assembly produces no more than 0.020 pounds VOC per start according to the California South Coast Air Quality District Rule 1174 Ignition Method Compliance Certification Protocol, dated Feb. 27, 1991, or an equivalent amount under a subsequent Ignition Method Compliance Certification Protocol or alternate protocol. More preferably, the assembly produces no more than 0.01, or no more than 0.005 pounds per start under the cited protocol.

In preferred embodiments, the suitable quantity of combustible alcohol-based fuel liquid placed in the container is between approximately 1 and 10 fluid ounces. Preferably, the quantity of combustible alcohol-based fuel liquid is between 2 and 6 fluid ounces, or between 3 and 5 fluid ounces. In other embodiments the quantity of fuel is 2–16 fluid ounces, 4–10 fluid ounces, 4–12 fluid ounces, 6–12 fluid ounces, or 6–10 fluid ounces In preferred embodiments the quantity of fuel is selected to provide at least 10, 15, 20, 30, 45, or 60 minutes of burn time.

In preferred embodiments, the principal alcohol in the fuel liquid is a 1, 2, or 3 carbon atom-containing alcohol, or a combination thereof. For example, the principal alcohol can be methanol, ethanol, isopropanol, or n-propanol, or a combination thereof. Preferably, the alcohol-based fuel liquid includes ethanol and at least 6% by weight isopropanol or other percentage as described in U.S. Pat. No. 5,858,031. Preferably the isopropanol content is in the range of 10–30%, most preferably 15–25%. Higher levels of isopropanol can be utilized, but generally at higher cost for the fuel. Enhanced and sustained flame visibility is provided by the presence of the isopropanol in the fuel liquid.

Preferably, the alcohol-based fuel liquid further includes an effective amount, i.e., concentration, of at least one bittering agent, for example, denatonium benzoate (CAS reg. no. 3734–33–6) or denatonium saccharide (CAS reg. No. 90823–38–4). Such a bittering agent helps prevent accidental ingestion of the fuel by children, while discouraging misuse by adults. Typically effective and sufficient amounts of denatonium benzoate that can easily be solubilized in such alcohol-containing fluids range between 0.01% and 0.05% by weight. Other suitable bittering agents can be selected by one of ordinary skill in the art.

In preferred embodiments, the alcohol-based fuel liquid further includes from 1% to 40% by weight water, preferably 5% to 35%, more preferably 10% to 35% or 15% to 35%, and most preferably 25% to 35%. The presence of water reduces the rate of combustion of the alcohol-based fuel liquid and the rate of heat transmission to the container. This feature helps prevent premature melting of the container and prolongs the fuel's combustion time, providing additional time to ignite charcoal or wood.

In preferred embodiments, the composition of the alcohol-based fuel liquid provides enhanced flame visibility upon combustion, by the inclusion of between approximately 65% and 100% by weight of a mixture of alcohols. The fuel can also contain between approximately 0% and 35% by weight of water. The mixture of alcohols includes an amount of isopropanol between approximately 6% and 66% by weight of the composition and an amount of ethanol between approximately 34% and 94% by weight of the composition, in which the weight ratio of isopropanol to ethanol does not exceed 2:1. The enhanced and sustained flame visibility is due to the presence of isopropanol in the composition.

Also in preferred embodiments, the container in the fire-starting assembly is fabricated from at least one plastic resin, preferably selected from the group consisting of polyolefins, polyesters, polycarbonates and combinations thereof. Within these groups, preferred resins include polyethylene, polypropylene, polyethylene terephthalate and combinations thereof. Plastics can be thermoplastic, thermoset, catalyzed setting or other plastic of suitable composition.

Preferably, the container measures between 0.5 and 3.0 inches in height and between 2 and 8 inches in diameter or width, and is configured in the form of an open bowl or tub. Also preferably, the thickness of its sidewall is substantially greater than thermoplastic films used to fabricate conventional pouches. Preferably the sidewall thickness is between approximately 0.010 and 0.040 inches, for example, approximately 0.010, 0.015, 0.020, 0.025, 0.030, 0.035 or 0.040 inches (±0.0025 inches), or in a range specified by any two of these values.

In preferred embodiments, the depth of the fuel in the container prior to burning is in the range ¼ inch to 1 inch, more preferably ¼ to ¾ inch, and most preferably 0.4 to 0.6 inch. Such fuel depths typically provide approximately 12–15 minutes burn time for alcohol-based fuels. In some applications, longer burn times are preferred. Thus, in other embodiments, the fuel depth is 1.5, 2, 2.5, 3, 3.5, or 4 (±0.25) inches, or in a range defined by taking any two of the depth values as endpoints of the range.

In preferred embodiments, the alcohol-based fuel liquid also comprises at least one thickening or gelling agent. In order to provide appropriate thickening characteristics, preferably the thickening agent or agents is present in an amount from 0.1% to 5% by weight, more preferably from 0.2% to 3%, still more preferably from 0.2% to 1% of the liquid composition. The thickening or gelling agent is preferably present in an amount effective to produce an absolute kinematic viscosity at 20° C. of from 250–100,000 cp. If it is desired that the fuel is pourable, the viscosity is preferably in the range of 1–25,000 cp, more preferably 100–25,000 cp, 100–10,000 cp, 1000–10,000 cp, or 1,000–25,000 cp. Such pourable embodiments are typically used where the end user will transfer the fuel into the combustible container. In embodiments where the container will be "factory filled," the viscosity is preferably higher, e.g., 10,000–100,000 cp, 25,000–100,000 cp, 25,000–50,000 cp, or 50,000–100,000 cp.

The thickening or gelling agent is preferably selected from the group consisting of cellulose derivatives, natural gums, inorganic thickeners, and synthetic homopolymers and copolymers having from 1 to 30 carbon atoms per monomer unit. Within the cellulose derivative group, the thickening agent is preferably selected from the group consisting of hydroxycellulose, hydroxyalkylcellulose, and carboxymethylcelluose. Within the hydroxyalkylcellulose group, the thickening agent is preferably selected from the group consisting of hydroxyethylcellulose, hydroxypropylcellulose, and hydroxypropylmethylcellulose. Within the synthetic homopolymer or copolymer group, the thickening or gelling agent is preferably selected from the group consisting of polyacrylic acids, polyacrylic acid esters, polyacrylic acid amides, polymethacrylic acids, polymethacrylic acid esters, polymethacrylic acid amides, polyvinylacetate, and polyvinylpyrrolidone.

Other anionic polymers useful in thickening alcohol-based fuels include sulfonated polymers, carboxylic acid derivatized polymers, and maleic anhydride-containing copolymers e.g., as described in Wesley et al., U.S. Pat. No. 5,641,890. The Wesley et al. patent also provides useful description on the selection and utilization of the cross-linked polyacrylic acid-type thickening agents sold by B. F. Goodrich under the Carbopol® trademark. These thickeners are particularly effective in thickening the presently described alcohol-based fuel liquids containing approximately 20% or more by weight of water.

Within the natural gum group, the thickening or gelling agent is selected from the group consisting of acacia, alginate, carrageenan, guar, karaya, pectin, tragacanth, and xanthan. Within the inorganic group, the thickening agent is selected from the group consisting of silicas and clays.

In order to prevent evaporation and/or leakage of the fuel liquid, the container should be sealed at the top. Such a seal may be performed in a variety of ways, and persons who select liquid packaging methods will be familiar with numerous such methods that can be used. For example, the top seal may be formed by sealing the upper portion of the sidewalls together. For example, the sidewalls can be pinched together from two opposite sides and sealed together (with or without crimping), e.g., using induction or heat sealing. Preferably the sealing is in such a manner that the top of the container can be opened by pulling apart the sealed sidewalls, or tearing at a tear line. Likewise, a gable top can be used, similar to that used for cardboard milk cartons, with the top edges of the sidewalls sealed together.

In other embodiments, the sealed top utilizes a tearable flap, or a sealed lid (e.g., a snap-on lid with or without additional sealing medium around the lid contact edge. The lid is preferably removably attached to the top of the container sidewalls, with or without the presence of a stiffened upper edge for the sidewalls. Likewise, the sealed top can utilize a rigid, semi-rigid, or flexible (e.g., a film) covering over an aperture, where the aperture is less than 80%, 50%, 40%, 30%, 20%, or 10% of the area of a horizontal cross-section of the container. The aperture is of sufficient size that it allows ignition of the fuel and burning of the side walls generally down to the surface of the fuel.

In other preferred embodiments, to provide a sealed top, the fire-starting assembly of the present invention includes an alcohol-impermeable sealing cover film that is sealingly attached to the upper edge of the container's perimeter sidewall. Depending upon the composition of the sealing cover film and the method of forming the seal, the resulting film attached to the container may be either peelable, i.e., "removable," or alternatively, may be non-peelable, i.e., "hermetic", requiring either piercing or cutting to gain access to the fuel for ignition. Generally, the hermetic seal is preferred because it provides an obstacle to a child who might otherwise open and accidentally ingest the fuel composition. Together with the container, the sealing cover film prevents leakage and evaporation of the fuel liquid during storage and shipping. This cover film is typically selected from the group which includes induction-sealable and heat-sealable thermoplastic films and foil-thermoplastic composite sheets.

The above sealing film which has been attached to the fuel-filled container is beneficially and preferably protected against accidental perforation and resultant fuel leakage by attaching an overcap lid to the container. This protection is useful, for example, during stacking the fire-starting assemblies in cases and shipping the cases, as well as during shelf storage. The overcap lid is placed over the sealing film, and is preferably frictionally secured to the outside surface of the perimeter sidewall of said container. As an alternative, the overcap lid can be directly attached to the sealing film, e.g., at the portions where the sealing film is attached to the container. Overcap lids are generally fabricated from either an inexpensive thermoplastic material, e.g., polyethylene, or from paperboard.

In preferred embodiments, the assembly includes printed instructions for use. Such instructions can be printed on the container, e.g., or on a sidewall, on an associated structure, e.g., on a sealing film, overcap, or other sealing structure. Alternatively, the instructions can be printed on a separate component, e.g., a sheet of paper attached directly or indirectly (e.g., in a plastic pouch) to the container. Indeed, instructions can be provided but not attached to the container, e.g., as part of a kit.

In a related aspect, the invention provides a combustible fire-starting assembly that includes a suitable quantity of combustible alcohol-based fuel liquid and a combustible means for containing said fuel liquid without leakage while allowing combustion of said fuel liquid and said combustible means. Particular embodiments includes embodiments as described for the assemblies described above.

In another aspect, the invention features a method of igniting charcoal and wood fires. The method involves igniting a combustible fire-starting assembly as described in the first aspect above, and burning the assembly beneath a suitable quantity of charcoal or wood to be ignited, at least for a time sufficient to ignite the charcoal or wood. The assembly can be placed beneath the wood or charcoal and ignited, or ignited and the wood or charcoal placed over it.

In preferred embodiments, the method of igniting charcoal and wood fires also includes providing the above-described assembly in which a freestanding plastic container holding the fuel is either hermetically sealed by a sealing film or sheet, or is sealed using a removable sealing film or sheet described above. The sealing film or sheet is removed, pierced or otherwise disrupted. The assembly is placed beneath a suitable quantity of charcoal or wood to be ignited, and the fuel in the container is ignited, or the fuel is ignited and the wood or charcoal is placed over the assembly. The assembly is allowed to burn beneath the wood or charcoal until it is fully consumed or at least for a time sufficient to ignite the quantity of charcoal or wood.

In preferred embodiments, the suitable quantity of charcoal is at least 2 pounds.

In yet another aspect, the invention features a kit that includes at least one combustible fire-starting assembly as described above, and a quantity of charcoal lumps (e.g., briquettes) suitable for preparing a charcoal fire or printed instructions for use, or both. Preferably the container for the fire-starting assembly has a sealed top, e.g., a sealing film with or without an overcap, a gable top, a pinch top, a sealed flap, a sealed lid, or a removable film over a container aperture.

In a preferred embodiments, the quantity of charcoal in the kit is at least 1, 2, or 3 pounds, e.g., 1 to 4, 1 to 3, 2 to 4, or 2 to 3 pounds.

In preferred embodiments, a kit includes a plurality of assemblies, e.g., 2, 3, 4, 6, 8, 10, or even more assemblies.

In another aspect, the invention provides a plurality of fire-starting assemblies as described above packaged together. Such packaging can, for example, utilize plastic film, cardboard, or paperboard as an outer container holding the plurality of assemblies.

In the context of this invention, the term "combustible fire-starting assembly" refers to the combination of a suitable flammable container, e.g., thermoplastic container, and a suitable flammable fuel, preferably alcohol-based, that has been placed in the container. Both the fuel and the container burn to completion in air once the fuel and/or its immediate vapors have been ignited by contact with a flame, spark or heat source.

The term "freestanding" refers herein to the structural properties of the combustible containers, e.g., of the present invention that allow them, when filled with fuel liquid, to stand upright alone, without significantly flexing, bending or showing other signs of collapsing that would allow harmful spillage of fuel even as the upper portion of the container's sidewall begins to burn. By contrast, conventional plastic pouches that are fabricated from conventional heat-sealed films or foil, are not considered freestanding, because when filled with liquid and then opened (e.g., by piercing or by flame penetration, such pouches tend to at least partially collapse and leak liquid.

The term "fuel liquid" refers to a fuel composition that is combustible in free-burning, contains combustible components that are liquid at room temperature and 1 atmosphere, and that can be poured and/or pumped or that at least partially liquefies during combustion.

The term "suitable quantity" (of combustible alcohol-based fuel liquid, or other selected fuel liquid) refers to an amount of such fuel (e.g., 1–10 fluid ounces) that is sufficient and preferably ample for igniting typical charcoal fires (2–8 pounds of charcoal) and camp and fireplace wood fires (3–4 dried logs). A quantity of 2–6 ounces of fuel is preferable, and 3–5 ounces is more preferable. For heat source uses for cooking or heating food, preferably a larger amount of fuel is used. Preferably an amount in the range of 2–16 oz, more preferably 4–14 oz, 4–12 oz, or 6–12 oz, most preferably 6–10 oz.

The term "alcohol-based fuel liquid" refers to a fuel in which alcohols constitute at least 50% by weight of the combustible components in the fuel liquid (combustible in free-burning), and typically refers to an ethanol-based fuel (preferably 34%–94% by weight ethyl alcohol) which is preferably supplemented with isopropyl alcohol (6%–66% by weight, and preferably 15%–30% by weight of the fuel) to provide flame coloration (a safety feature). Other alcohols may be included, e.g., methanol, n-propyl alcohol, but ethyl alcohol is preferred as the base fuel. Water (up to approximately 35% by weight of the final fuel liquid) is preferably included in the fuel to slow the combustion rate of alcohol and control the rate of heat generation. This allows less alcohol to be utilized to sustain the starting fire that should last approximately 10–12 minutes to assure that a typical charcoal or wood fire has been well ignited. Also with a somewhat slower and "cooler" fire, the walls of the plastic container holding the fuel are less stressed and experience a slower process of melting.

It is important that the container, e.g., plastic container, holding the fuel is "alcohol-resistant', i.e., chemically unreactive during long term contact (at least 2 years at room temperature) with the fuel liquids containing the lower alcohols listed above. If it is chemically unreactive, the container should neither soften nor become embrittled during this period due to contact with the alcohol(s) (or other liquid) in the fuel liquid.

Similarly, it is important that the container, e.g., plastic container, is essentially "alcohol-impermeable" with respect to these alcohols. That is, after an alcohol-impermeable lid seal has been added to the container, a 2 year storage period should result in less than 10% of the alcohol content of the product being lost. In fact, preferably less than 5% of the alcohol should be lost via permeation of the container during this period. If a different liquid(s) is used in the fuel, the containers should be impermeable to such liquid.

The terms "bottom wall" and "perimeter sidewall" refer to the configuration of the container. For example, a shallow round plastic tub typically utilized for packaging food products is one preferred form of the container. The container rests on its bottom wall when it is placed in a grill or in a fireplace and ignited. The perimeter sidewall which extends around and upward from the bottom wall (and is therefore "continuous" with the bottom wall) provides the volume capacity of the container.

In reference to the bottom wall and side walls, the term "continuous" means that the bottom wall and side walls together form an open container such that the container will hold a volume of compatible liquid less than the capacity of the container without leakage. Typically the bottom and side walls are formed of one piece of material, but the side walls can be formed of one or more separate pieces sealingly joined to the bottom wall. If the side walls are formed of multiple pieces, those pieces are also sealingly joined together to form a perimeter side wall.

For the material from which the container is made, the term "suitable composition" refers to a material that will burn in association with free-burning of a selected fuel composition in the container. The material need not be of uniform composition through a wall, bottom, or other portion of the container. For example, the material may be layered, where the layers may be the same or different, e.g., a plastic layer or film on paper or cardboard. Likewise, not all portions of the container need be made of the same material. For example, side walls and the bottom may be of different materials so long as they are sealed to each other. The material is highly preferably impermeable and resistant to the liquids in the fuel composition, at least at the concentrations used in the particular fuel with which that container is used. Typically, plastic containers will be used, e.g., thermoplastic, thermoset plastic, catalytic setting plastics, etc.

Still referring to the container, the term "suitable thermoplastic composition" or "suitable plastic composition" refers to the type of resin used in the manufacture of the container. The container is typically fabricated by blow-molding, injection molding, or thermoforming, and preferred resins used in these fabrications are polyolefins, polyesters and polycarbonates which, when burned, produce principally carbon dioxide, water and little air pollution.

The term "adequate thickness" in reference to the thickness of the container sidewall and in conjunction with its thermoplastic composition, means that the sidewall continues to hold the fuel liquid without leaking throughout the period of time required to burn the fuel. In order to prevent fuel leakage, the sidewall must remain intact and impermeable to the alcohol-based fuel liquid, and also retain "adequate rigidity", i.e., the side wall(s) remain self-supporting and do not buckle or collapse during the burning of the fuel liquid. Trial burning of ethanol-based fuels has indicated that for most preferred resins, a sidewall thickness of at least 0.010 inches (10 mils) is advisable, and 0.020 inches or greater is preferable. Preferably the side wall thickness is such that the wall burns down together with the fuel rather than having the fuel burn out of the container leaving at least 25% or 50% of the side wall unburned. Usually the side wall thickness is no more than 0.10 inches, preferably no more than 0.08 inches, still more preferably no more than 0.06 inches, and most preferably no more than 0.04 inches. An advantage of polypropylene resin over polyethylene is that polypropylene has a higher softening and melting temperature. Both of these polyolefinic resins have an advantage over polyester and polycarbonate in being less costly. The polyolefinic resins are composed of carbon and hydrogen-based molecules, and the polyester and polycarbonate resins additionally contain the oxygen atom in their molecular structure. As indicated above, these resins are substantially clean-burning.

The term "chlorinated compounds" refers to compounds containing chlorine which, when burned, might produce toxic organic compounds. Such compounds include chlorine-containing thermoplastic resins such as polyvinyl chloride, and any chlorine-containing additives to such resins that might otherwise have been used in fabricating the container, and any chlorinated substances that might appear in the alcohol-based fuel. More broadly, "halogenated compounds" refer to compounds containing one or more types of halogen atoms, i.e., F, Br, Cl, I.

In reference to the amount of a particular type of component (e.g., chlorinated compounds) in a container material, the term "substantially free" means that the material contains less than 20% by weight of the specified component, preferably less than 10%, still more preferably less than 5%, and most preferably less than 2% or even less than 1% of the specified component.

The term "free-burning," in the present invention, refers to the open air combustion of alcohol-based fuel liquids. The term is described elsewhere herein, and in U.S. Pat. No. 5,858,031. Free-burned fuels include, for example, those that are burned in an open reservoir such as in an open cup or tub, in a dish, on a sheet of aluminum foil or on previously burned ash, or in the bottom of a fireplace or barbecue grill for example.

The combined use of isopropanol and ethanol to "enhance and sustain flame visibility" and the concentration ratios and ranges of ethanol, isopropanol and water used in blended alcohol-based fuel liquids is also described in the above U.S. Pat. No. 5,858,031.

A generally open shape, e.g., a cup, bowl or shallow tub-type configuration, is preferred for the container used to hold the alcohol-based fuel so that ample air (oxygen) can reach the burning fuel. Such containers fabricated from polyolefins thermoplastics and polyesters, e.g., PET, are routinely manufactured (e.g., Airlite Plastics, Inc., Omaha, Nebr.) for the food packaging industries and are commercially available. A lip forming the upper edge of the sidewall portion of such tubs or cups is typically smoothed and shaped to accept a sealing film or foil-thermoplastic composite sheet seal that can be applied by high speed commercial packaging machines designed to fill and seal plastic tubs. However, other container shapes can also be used. For example, cylindrical containers can be used, e.g., cylindrical containers that are up to ⅛, ¼, ⅓, or ½ as tall as they are wide. For longer burning assemblies relatively taller cylinders can be used, e.g., cylinders that are at least half as tall as they are wide, or at least as tall as they are wide. Likewise, containers that are rectangular (with or without rounded corners) can be used. Containers that have openings smaller than the body of the container can also be used, so long as the portion of the container above the fuel can be burned or otherwise conveniently removed.

The term "sealing cover" which is used in a preferred embodiment of the fire-starting assembly is any of a variety of commercially available sealing films or sheets that are essentially unreactive with, and impermeable to alcohol liquid and vapor as described and as quantified above for the container itself. The sealing cover material is attachable (e.g., by heat-sealing or induction sealing using methods known in the packaging art) to the upper edge or lip of the perimeter sidewall of the container. The sealing cover film or sheet as used herein prevents significant loss of fuel from the container during storage and shipping, either by leakage or evaporation. Sealing films are used in the food packaging industry to seal thermoplastic containers. These seals fall into at least two different material categories and two "functional" categories. There are thermoplastic film materials often consisting of two or three fused layers of different resins, e.g., polyester/polyethylene and polypropylene/polyethylene sealing films. There are also foil-thermoplastic composite sheet materials used in container sealing. The presence of aluminum foil in the latter sheets tends to minimize any gas exchange across the sealing cover. While foil-containing sealing materials were shown to prevent all measurable alcohol escape from containers, Applicant has determined that many thermoplastic sealing films including polyester barrier films and polypropylene barrier films, provide adequate barriers that prevent excessive escape of ethanol and other alcohols. In terms of differing functional seals on plastic containers, a packaging machine may apply either a removable (peelable) seal or, alternatively, a "hermetic" seal.

Hermetic seals are permanently welded to the container lip and cannot readily be peeled off. Hermetic seals are pierced or torn away to gain access to a container's contents. In the case of flammable and denatured liquids as described herein, i.e., liquids that should not be ingested or otherwise misused, the hermetic seal is a useful child-resistant safety feature, and is the preferred functional seal in the present invention.

The term "thickening or gelling agent" which is preferably added to the alcohol-based fuel liquid refers to any of a wide range of organic and inorganic materials, chemical compounds, and combinations of compounds that act to increase the viscosity of a liquid solution, suspension or emulsion. Preferably, such an agent or agents are not present in such a large amount as to cause solidification of the fuel liquid. That is, it is desirable that the fuel composition remain sufficiently fluid, at least during pumping of the fuel, to allow automated filling of the above-described containers with the fuel. Thus thickening and partial gelling are acceptable states for the alcohol-based fuel liquid. A thixotropic agent such as pH-neutralized polyacrylic acid is particularly useful because it provides a higher viscosity in a resting liquid and a lower viscosity in a moving liquid, e.g., in a liquid being pumped and dispensed into a container. Depending upon a variety of parameters, a wide range of absolute kinematic viscosities may be desirable. Thus the viscosity may vary from being very liquid (e.g., 250 cp at 20° C.) to nearly gelled (e.g., 100,000 cp at 20° C.). Likewise, the agent or agents used to build viscosity may range from organic vegetable gums to inorganic thickeners like silicas and clays. As long as little or no harmful volatile organic compounds are generated from free-burning the thickener(s), they may be utilized.

The term "bittering agent" refers to a chemical which, when added to an alcohol-based fuel liquid, has the effect of discouraging or interfering with its ingestion, particularly its accidental ingestion by children. One preferred bittering agent is denatonium benzoate (also known as Bitrix®) which can be added to the fuel liquid at a final concentration of approximately 0.01%–0.05% by weight. This level of denatonium benzoate produces extreme bitterness in the mouth, causes oral rejection, and is therefore considered an "effective concentration or effective amount." of this agent.

As used herein in connection with fire-starting or heat-providing assemblies, components of such assemblies, and the use of such assemblies, the term "approximately" indicates ±20% of the stated value unless indicated to the contrary. In certain embodiments, the range about the stated value is ±10%, ±5%, ±2%, or even less.

By "comprising" is meant including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

While the assemblies, methods, and kits described above are particularly advantageous for fire starting, they can also be used as heat sources for other purposes. For example, an assembly can be used for heating, or even cooking foods and beverages by burning the assembly beneath the food or beverage. As an example, assemblies can be used for camping, picnicking, catering, and the like, e.g., as single use fuel sources. For such applications, the amount of fuel provided can readily be adapted to the intended use to provide a suitable burn period. In addition, it may be preferable to utilize a smaller and/or deeper container as compared to fire starting applications. In this way a more directed heat application is achieved. Embodiments described for fire-starting applications are also useful, more generally as heat-providing assemblies.

Thus, in another aspect, the invention provides a combustible heat-providing assembly that includes a suitable quantity of combustible fuel liquid held within a freestanding, combustible, fuel-resistant and fuel-impermeable plastic container. The container is configured with at least a bottom wall and a perimeter sidewall that is continuous with said bottom wall. The upper portion of the container is substantially open to the air to allow free-burning of the fuel liquid. Also, the container is of a suitable plastic composition and the sidewall(s) is of an adequate thickness and rigidity for the container to retain the fuel liquid without leakage throughout the period of combustion of the fuel liquid as the sidewall gradually diminishes in height as it melts and burns downward toward the bottom wall.

Embodiments as described for fire-starting assemblies are also included in this aspect.

In a related aspect, the invention provides a method for heating a material utilizing a heat-providing assembly as described. The method involves igniting the fuel in an assembly that includes a suitable quantity of combustible alcohol-based (or other combustible liquid-based) fuel liquid held within a freestanding, combustible, alcohol-resistant and alcohol-impermeable container (or similarly resistant and impermeable to an alternative combustible liquid) The container is configured with at least a bottom wall and a perimeter sidewall that is continuous with said bottom wall. The upper portion of the container is substantially open to the air to allow free-burning of the fuel liquid, and the container is of a suitable composition and the sidewall is of an adequate thickness and rigidity for the container to retain the fuel liquid without leakage throughout the period of combustion of the fuel liquid as the sidewall gradually diminishes in height as it melts and burns downward toward the bottom wall; and allowing the fuel liquid to burn beneath the material.

In still another aspect, the invention provides a heat-providing kit, that includes a plurality of heat-providing assemblies packaged together. Such packaging can, for example, utilize plastic film, cardboard, or paperboard as an outer container holding the plurality of assemblies.

Other features and advantages of the invention will be apparent from the following description of the preferred embodiments, and from the claims.

DESCRIPTION OF THE PREFERRED EMBODIMENTS

As described in the Summary above, the present invention concerns a fire-starting and/or heat-providing assembly useful for starting charcoal and wood fires and for cooking foods and/or heating various materials, and involves the packaging and subsequent combustion of suitable fuels, preferably alcohol-based fuels including methanol, ethanol and propanol, and combinations thereof. These fuels are packaged and free-burned in a suitable freestanding container as described earlier.

In such applications it was found that the behavior of free-standing containers and sealed plastic pouches (typically having a 0.002–0.005 inch wall thickness) differs. Such sealed pouches can also hold alcohol-based fuel liquids, but being flexible and not freestanding, tend to collapse and leak fuel after being penetrated either by mechanical means or during the process of burning (see, for example, the Wyer reference cited above, in which an ignited fuse is utilized to open and burn a pouch of fuel).

On the other hand, Applicant has discovered that a free-standing open-style plastic container having a somewhat greater wall thickness (typically 0.010 inches or greater) will not leak alcohol-based fuel during combustion. In such an open container the fuel is easily ignited by contact with a match. An example of the latter container is a shallow polypropylene tub typically used for packaging foods. One typical polypropylene tub measures approximately 4 inches in diameter, and has a perimeter sidewall that is approximately 1 inch in height and 0.020 inch thick.

Remarkably, when a 70% by weight alcohol-based fuel is burned in this container, a portion of the perimeter sidewall extending up to the level of the fuel's surface holds its shape, while a portion of the perimeter sidewall above the level of the fuel's surface undergoes a process of melting and combustion (starting from the top and moving downward). That is, as an alcohol-based fuel burns in the container, the uppermost exposed portion of the container's sidewall initially melts and burns, but the sidewall surprisingly ceases to melt or burn below the level of the burning fuel. Thus, the burning fuel remains safely held and confined within the container. The container (its sidewalls and bottom) burns to completion only after the fuel inside has been fully consumed.

A significant part of the invention is the compatible selection of a freestanding combustible container and a fuel liquid (together termed a "combustible fire starting assembly" or more generally a "combustible heat-providing assembly"). Highly preferably, both contain principally carbon, hydrogen and oxygen atoms so that upon combustion, principally water and carbon dioxide are produced rather than air pollutants. The assembly is highly preferably substantially free of chlorinated (or other halogenated) compounds that, upon burning, may produce dioxin or other toxic substances. Thus, for example, the use of polyvinylchloride plastics in the assembly should be avoided.

The present invention overcomes several limitations observed with alcohol-based fuels burned either with no containment means, burned in a metal canister, or burned in combustible pouches. With no containment means, a liquid fuel may leak out the bottom of a grill. Metal canisters prevent fuel leakage but have the disadvantage of leaving unburned metal waste material. On the other hand, a flexible pouch such as that described by Spilles (see above), if used with a liquid fuel of the present invention, will either leak as the pouch rapidly burns away (as intended for a paste fuel), or will extinguish the fire after initially being ignited if the polyethylene layer is made too thick. The elongated conventionally sealed plastic pouch-like container of Wyer (see above), requires a burning fuse to melt through the container and ignite the fuel. As in the case of Spilles, a liquid fuel would be expected to leak from this container.

By contrast, a freestanding combustible plastic container whose structure is more robust than a plastic pouch, and whose sidewalls are self-supporting (such as a polypropylene tub filled with an alcohol-based fuel), has the advantage of burning in a controlled manner without leaking.

For understanding the mechanics underlying the present invention, it is instructive to compare the burning of a fire-starting assembly as described herein, to that of an oversized non-drip candle. Typical non-drip candles are fabricated with a thin but confining outer layer or shell of high melting temperature wax surrounding a core of low melting temperature wax nearer the wick. As the candle burns and the molten wax at its center begins to be consumed, its level begins to fall. The upper portion of the outer wax shell (i.e., the candle's rim) becomes exposed to greater heat from the flame and begins to melt. This melting is controlled and slowly progresses downward. The outer wax shell continues to confine the molten core wax as the core is depleted and the wick grows shorter.

In the present invention, the plastic sidewall of the container holding the alcohol-based fuel, functions like the outer confining shell of high melting temperature wax in the non-drip candle, and the alcohol liquid inside the container may be compared to the core of molten candle wax. That is, as the alcohol fuel in the container is depleted and its level falls, the newly exposed uppermost portion of the plastic sidewall is exposed to greater heat and flame, and melts and burns away. Obviously unlike the candle which burns from a central wick, the alcohol fuel in an open plastic container burns over its entire exposed surface.

It is important to understand that the present invention is directed to the use of alcohol-based fuels (or other suitable fuels) that can be safely free-burned in the above-described plastic containers. For example, odorless mineral spirits fuel is currently the most prevalent charcoal lighter, and it is applied directly to pieces of charcoal before they are ignited. However, when burned in an open polypropylene tub, for example, mineral spirits fuel burns too rapidly, and produces a hazardous flaring fire. Furthermore, the heat generated is so great that the sidewall of the container generally melts downward below the level of the fuel, allowing hazardous fuel leakage.

Free-burning combustion as used in the present invention does not require adjustable hardware to regulate air or fuel flow such as in an alcohol stove. In fact, free-burning of a fuel is the combustion of a pre-measured or pre-dispensed quantity of fuel in an open reservoir or on an open surface in the ambient air, e.g., combustion of a fuel in an open cup or canister, in a dish, on a sheet of aluminum foil, on the bottom of a barbecue grill, or in a fireplace. Thus, as an example, a shallow polypropylene tub is filled with a thickened mixture of ethanol, isopropanol and water, and is placed in the bottom of a barbecue grill beneath a quantity of charcoal briquettes (or in a fireplace beneath wooden logs) and is ignited.

When alcohols containing three or more carbon atoms, e.g., propyl, isopropyl and butyl alcohols, are free-burned as either pure or aqueous diluted fuels, they produce a yellow and typically sooty flame. However when the one and two carbon lower alcohols, methanol and ethanol are free-burned, they tend to produce flames with very little color. Absolute methanol produces only a faint bluish flame, while ethanol produces a slightly yellowish flame. In the present invention, ethanol is a preferred fuel over methanol because of its lower volatility, lower toxicity, and higher heat of combustion. Regarding its environmental status, ethanol is a renewable, non-polluting and biodegradable fuel.

As used in the present invention, water is useful as a diluent to increase the flash point and therefore the safety of handling and transporting ethanol-containing fuels. Water also beneficially reduces the rate of combustion of the alcohols, and thereby extends the duration of combustion of a given amount of alcohol. This extended time is helpful, for example, when the alcohol is used as a lighter fluid to ignite other fuels such as wood and charcoal, or when used as a heating fuel for heating or cooking food. When ethanol is free-burned either in liquid or gelled form with a substantial concentration of water being present (i.e., more than approximately 10% by weight), its yellow flame color (a safety feature) disappears. The ethanol then burns with an essentially colorless or faint blue flame that is very difficult to see in bright sunlight. It is believed that with water addition to the fuel, heat is consumed in evaporating the water during ethanol volatilization and burning, thereby reducing the fuel's temperature and, in turn, the rate of alcohol vaporization and combustion. With less ethanol vaporizing, the oxygen demand of the fire is reduced and the flame therefore burns "cleaner", i.e., without any yellow color.

As an example, Applicant has found that a commercial product known as Sterno® (Colgate-Palmolive, Inc., Tenafly, N.J.) containing gelled ethanol, methanol and water burns with only a faint blue flame which is difficult to see in daylight. In the present invention, the addition of isopropanol to aqueous ethanol to achieve flame coloration, is helpful, as described in U.S. Pat. No. 5,858,031, and may prevent some accidental burn injuries.

In addition, Applicant has unsuccessfully attempted to use the Sterno® product for initiating combustion of solid fuels including barbecue charcoal and logs. The gelled Sterno® material burns too slowly and generates too little heat to be effective. Also, the empty metal can left after the fuel is consumed is an undesirable waste product that is generally discarded.

As was also described in U.S. Pat. No. 5,858,031, alcohol-based liquid and gelled fuels are used for igniting solid fuels such as chunks of charcoal, wooden fireplace logs and other fuels. The alcohol-based fuel is placed a small distance beneath the solid fuel, and the heat from the burning alcohol fuel rises and ignites the solid fuel. However, several problems may be experienced during the burning of non-containerized thickened alcohol-based fuels, particularly when the fuel is placed in the bottom of a grilling device such as a charcoal barbecue grill. For example, in spite of the alcohol-based fuel being thickened, some of the burning fuel can leak out through cracks or vent holes in the bottom of a barbecue grill and cause an accidental fire beneath the grill. The leakage problem may be more severe if the thickened alcohol loses its viscosity as it burns. For example, Applicant has found that if a pH-neutralized, crosslinked polyacrylic acid thickener is utilized to produce a thickened alcohol-based fuel liquid (e.g., Carbopol® thickener, B. F. Goodrich, Industrial Specialties, Cleveland, Ohio), and if the thickened fuel contacts certain metallic surfaces in the bottom of a grill, then the fuel's viscosity can rapidly diminish.

To deal with these problems, Applicant initially experimented with packaging pre-measured quantities of alcohol-based fuels in a variety of combustible plastic pouches as described by Spilles and by Wyer (see above). That is, a pouch might prevent fuel leakage if the thickened alcohol fuel remained stationary in the pouch as it burned. In practice however, it was found that as a combustible plastic-walled pouch burned, the thickened alcohol stored inside tended to leak out. On the other hand, as Spilles points out, combustion of the fuel is blocked altogether if the film material constituting the pouch is too thick. As a result, Applicant failed to find a suitable pouch material that would allow long term storage as well as subsequent burning of an alcohol-based fuel, while also preventing fuel leakage.

Putting the present invention in perspective, Applicant has experimented with a number of alternative methods for safe containment of alcohol-based fuels during combustion. These have included placing the fuel in combustible absorbent materials such as paper fiber and cellulose sponge, as well as burning the fuel in a variety of combustible containers. The simplest and most reliable device to emerge from these experiments was the freestanding combustible thermoplastic container, e.g., a rigid or semi-rigid-walled shallow plastic tub (a variety of such tubs are typically used for packaging foods such as margarine and cream cheese).

Considering the plastic tub, its containment of fuel depends upon the persistence of intact portions of this container including at least its bottom wall portion and that portion of the perimeter sidewall up to the level of the fuel's surface (for preventing lateral leakage of fuel liquid from the container). The perimeter sidewall, as previously described, is continuous with, and extends upward from the container's bottom wall to a height (above the bottom wall) which is sufficient to prevent lateral leakage of fuel liquid during the period of the fuel's burning (i.e., until the fuel is exhausted or the fire extinguished). As long as residual alcohol-based fuel liquid persists in the bottom of a plastic container (e.g., on the upper surface of the bottom wall of a shallow polypropylene tub), this bottom wall does not ignite.

"Examples of suitable containers which are also clean-burning, i.e., burning with 15 negligible smoke or odor, are the 4–6 oz size of injection molded polypropylene tubs (e.g., part numbers 451 and S651. Airlite Plastics Company; Omaha, Nebr. which are both made from plastics containing less than one percent of inorganic materials). An example of a suitable alcohol fuel is: 70% by weight alcohol including 54% by weight ethanol, 16% isopropanol, 30% water, and 0.3% Carbopol®Ultrez 10 polyacrylate thickener (BFGoodrich Specialty Chemicals, Cleveland, Ohio), providing a kinematic viscosity of 15,000–30,000 cp. In other embodiments, the viscosity may be as low as 250 cp and as high as 100,000 cp, or even fully gelled."

Such a thickened alcohol-based fuel liquid can be stably packaged for extended periods, e.g., for at least 2 years, in a hermetically sealed rigid polypropylene or polyester (e.g., PET) container. Hermetic sealing films that are chemically unreactive upon prolonged contact with the alcohol-based fuels described herein, and that are useful in preventing evaporation of these fuels include, without limitation, multilayer plastic-foil composite films, and multilayer thermoplastic films known in the art. A variety of such sealing films are manufactured, including those of Mobil Chemical Company, Films Division (Macedon, N.Y.). Examples include, metallized and non-metallized, biaxially oriented polypropylene barrier films (Mobil) as well as metallized and non-metallized polyester barrier films. These containers have been subsequently opened and burned, during which the fuel liquid remains safely contained until the fuel is exhausted in spite of the fact that the portion of the container above the fuel is also burning.

Using the above-described fire-starting assemblies, charcoal fires are quickly and conveniently started in barbecue grills, for example, as follows: The charcoal support grate is removed from the grill (e.g., kettle style grills manufactured by the Weber-Stephen Product Co., Palatine, Ill.). The sealed fire-starting assembly is placed in the bottom portion of a barbecue grill. The hermetic sealing film that covers the plastic tub and alcohol-based fuel is partially removed or at least cut open by knife or scissors (optionally, this step may precede placing the assembly in the bottom portion of the grill). The charcoal support grate is returned to its original position, and an appropriate quantity of charcoal (e.g., 4–6 pounds) is loaded onto the grate, leaving a little open space directly over the tub for lighting the fuel. A lighted match is conveniently used to ignite the alcohol fuel (a regular match may be dropped into the tub through the grate or a longer match may be extended downward to contact the fuel). Before the alcohol fire begins to generate substantial heat, it is helpful to move and pile up the charcoal (lumps or briquettes) directly over the burning alcohol fuel. Within 10–15 minutes the charcoal is adequately ignited and may be spread out on the charcoal support grate to begin cooking. Generally, within a minute after igniting the alcohol, the portion of the plastic fuel container wall that extends upward above the surface of the burning fuel has melted and/or burned away.

Remarkably, however, the flame around the container's perimeter sidewall does not migrate downward below the surface of the fuel. In effect, the contact with cooler liquid and perhaps the boiling and evaporation of water and alcohol (a water-ethanol azeotrope boils at only 78° C.) prevents melting of the container beneath the surface of the fuel liquid. The lower wall of the rigid container continues to support the fuel liquid as it burns, and does not itself begin to burn until the alcohol has been consumed. Also, the presence of any water in an alcohol-based fuel reduces the rate of fuel combustion, and thereby reduces the rate of heat generation. This appears helpful in preserving the integrity of wall of the container.

By contrast, very rapid and hot-burning (high heat of combustion) fuels such as mineral spirits tend to rapidly melt such plastic containers causing fuel leakage. To safely free-burn a petroleum-based fuel such as mineral spirits, it would be necessary to substantially reduce the fuel's rate of combustion and consequent rate of heat generation and/or use a higher melting point plastic.

Given a ready supply of air in a barbecue grill, the perimeter sidewall of a typical polypropylene tub (described above) will burn downward to the level of liquid or gelled alcohol fuel remaining in the container. As the fuel burns and its level falls, the height of the unburned perimeter sidewall correspondingly diminishes. Finally, when the fuel is completely consumed, the lower bottom wall of the container burns too. Plastic containers fabricated from clean-burning thermoplastic materials such as polyolefins, polyesters, polycarbonates and combinations of these materials have been used to package and burn the alcohol-based fuel liquids described herein. Combustion of these plastics as well as the alcohol-based fuels composed almost exclusively of molecules containing the carbon, hydrogen and oxygen atoms, produces principally water and carbon dioxide. Chlorinated plastics such as PVC (polyvinylchloride) are avoided since these may produce toxic byproducts upon burning.

In accordance with the description above, additional fire starting or heating assemblies can be constructed using other types of fuels. In utilizing a combustible fuel in an impermeable container, it is important that the bottom and side walls of the container do not allow leakage of the fuel, e.g., do not melt or otherwise perforate during combustion of the fuel. Thus, for a particular selection of a fuel composition, a container is selected that does not melt or otherwise perforate below the fuel level during combustion of the fuel but which is still combustible above the fuel level under conditions of burning of the contained fuel. For particular fuels, additional components may be included, similar to the addition of water to alcohol, that control the temperature and/or rate at which the fuel burns. Such added components can include for example combustible or non-combustible liquids and/or combustible or non-combustible solids, e.g., clay, sand, cellulose, and the like. For liquids, an added liquid or liquids should mix uniformly and not undergo phase separation under expected storage and use conditions. Of course, a container can be selected first and a compatible fuel then selected, or the selections can be made in combination, with or without improvement or optimization of one or both of fuel and container.

Exemplary fuels can include without limitation mineral spirits, and lower alkanes. Such lower alkanes include, for example, pentane, hexane, heptane, octane, nonane, and decane, as well as structural isomers thereof and/or combinations of such compounds.

Combustible containers for higher temperature applications can include, for example, containers formed of plastic materials utilized for plastic baking dishes.

Still further, recognizing that combustible thermoplastic containers are effective during combustion of the contained fuel, such containers can also be used for solidified or partially solidified fuels, e.g., fuels such as the Sterno® fuel referenced above. Other solidified and semi-solidified fuel compositions can also be utilized preferably one that is sufficiently fluid during processing to allow the containers to be filled by pumping, pouring, or the like. Preferably the size of the container and the amount of fuel is selected for single use application. Thus, the amount of fuel can be selected to provide pre-selected burning periods, e.g., 5, 10, 15, 20, 30, 40, 50, 60 or more minutes of burning. Although such fuels do not have the spillage control issues associated with liquid or gelled fuels, the fuel container still should be sealed to prevent evaporation of liquid fuel components prior to use.

EXAMPLE 1

Alcohol-Based Fuel Leaks from Conventional Plastic Pouches During Combustion.

Approximately 4 oz. quantities of polyacrylate-thickened alcohol-based fuel liquids (as defined above, containing approximately 70% by weight of an ethanol-isopropanol blend and 30% by weight water, viscosity ranging from 10,000–15,000 cp) were heat-sealed inside 0.002 inch thick polypropylene and 0.002 inch thick polyester pouches. One at a time, these pouches were placed in the bottom portion of a kettle style barbecue grill. The pouches were ignited by several different methods including lighting a wick along the pouch perimeter and piercing the top of the pouch to expose the fuel which was then ignited by match. Regardless of the ignition method, as the fuel burned, it tended to boil and ooze from the pouches, and move toward the vent holes in the bottom of the grill. Leakage of fuel from the grill poses a fire hazard.

EXAMPLE 2

Petroleum-Based Lighter Fluid Leaks from Freestanding Plastic Containers During Combustion.

Odorless Mineral Spirits (abbreviated OMS) is the most common conventional lighter fluid for charcoal. Rather than applying it directly to charcoal in the conventional manner, Applicant placed between 2 oz. and 4 oz. of OMS into 4.6 inch diameter polypropylene tubs (wall thickness 0.020 inches, Airlite Plastics Company, Omaha, Nebr.). Each tub was placed in the bottom portion of a kettle style barbecue grill. The fuel in each tub was ignited by match. Within a short period of time following ignition (0.5–2 min), the high level of heat from the burning OMS caused structural failure of the tubs (melting penetration of either the sidewall or bottom wall of the tubs). Consequently, rapid leakage of OMS from the tubs onto the metal floor of the kettle grill occurred. This leakage of fuel posed an immediate fire hazard.

EXAMPLE 3

Alcohol-Based Fuel Does Not Leak from Freestanding Plastic Containers During Combustion.

Two and four oz. volumes of polyacrylate-thickened alcohol-based fuel liquids (as defined above, containing approximately 70% by weight of an ethanol-isopropanol blend and 30% by weight water, viscosity ranging from 10,000–15,000 cp) were placed, respectively, into 4 oz. and 6 oz. capacity polypropylene tubs (3.6 and 4.6 inch diameter respectively, wall thickness 0.020 inches, Airlite Plastics Company, Omaha, Nebr.). Each tub was placed in the bottom portion of a kettle style barbecue grill. The fuel in each tub was ignited by match. The fuel boiled and burned within each tub over a period of 12–16 minutes. As the fuel in each tub was consumed and its level dropped, the newly exposed uppermost portion of each tub's sidewall gradually melted downward and burned. However, no fuel leakage occurred with any of the tubs. That is, structural integrity of the bottom wall and enough of the sidewall of each tub was maintained during combustion to prevent fuel leakage. This result stood in sharp contrast to the results in Examples 1 and 2, where leakage of fuel from each container was observed.

All patents and publications mentioned in the specification are indicative of the levels of skill of those skilled in the art to which the invention pertains. All references cited in this disclosure are incorporated by reference to the same extent as if each reference had been incorporated by reference in its entirety individually.

One skilled in the art would readily appreciate that the present invention is well adapted to obtain the ends and advantages mentioned, as well as those inherent therein. The methods, variances, and compositions described herein as presently representative of preferred embodiments are exemplary and are not intended as limitations on the scope of the invention. Changes therein and other uses will occur to those skilled in the art, which are encompassed within the spirit of the invention, are defined by the scope of the claims.

It will be readily apparent to one skilled in the art that varying substitutions and modifications may be made to the invention disclosed herein without departing from the scope and spirit of the invention. For example, using other fuel compositions and combustible free-standing containers are all within the scope of the present invention. Thus, such additional embodiments are within the scope of the present invention and the following claims.

The invention illustratively described herein suitably may be practiced in the absence of any element or elements, limitation or limitations which is not specifically disclosed herein. Thus, for example, in each instance herein any of the terms "comprising", "consisting essentially of" and "consisting of" may be replaced with either of the other two terms. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In addition, where features or aspects of the invention are described in terms of Markush groups or other grouping of alternatives, those skilled in the art will recognize that the invention is also thereby described in terms of any individual member or subgroup of members of the Markush group or other group.

Also, unless indicated to the contrary, where various numerical values are provided for embodiments, additional embodiments are described by taking any 2 different values as the endpoints of a range. Such ranges are also within the scope of the described invention.

Thus, additional embodiments are within the scope of the invention and within the following claims.

What is claimed is:

1. A combustible assembly comprising a quantity of alcohol-based fuel liquid held within a freestanding, combustible, alcohol-resistant and alcohol-impermeable open container fabricated from at least one plastic resin, wherein said container is substantially free of inorganic materials, and is of a shape which is a member of the group which consists of:

(a) a bowl;

(b) a cup;

(c) a tub; and (d) a dish;

said container having a height, and comprising an opening at a point of maximum width, wherein the maximum width is at least equal to the height, and wherein said container is of a, thickness and rigidity as to retain said liquid without leakage throughout the period of combustion, with said container entirely consumed together with the liquid.

2. The assembly of claim 1, A wherein said fuel liquid and said container are composed of materials consisting essentially of carbon, hydrogen and oxygen atoms which, upon combustion, produce water and carbon dioxide, and are substantially free of chlorinated compounds.

3. The assembly of claim 1 wherein said suitable quantity of combustible, alcohol-based fuel liquid is between approximately 1 and 10 fluid ounces.

4. The assembly of claim 1, wherein said suitable quantity of combustible alcohol-based fuel liquid is between 2 and 6 fluid ounces.

5. The assembly of claim 1, wherein said liquid further consists of alcohol selected from the group consisting of 1, 2, and 3 carbon atom-containing alcohols, and combinations thereof.

6. The assembly of claim 5, wherein said alcohol is selected from the group consisting of methanol, ethanol, isopropanol, n-propanol, and combinations thereof.

7. The assembly of claim 1, wherein said alcohol-based fuel liquid comprises ethanol and at least 6% by weight isopropanol, wherein enhanced and sustained flame visibility is provided by the presence of said isopropanol in said fuel liquid.

8. The assembly of claim 1, wherein said alcohol-based fuel liquid further comprises between 1% and 35% by weight water, wherein said water reduces the rate combustion of said liquid and the rate of heat transmission to said container.

9. The assembly of claim 1, wherein said fuel liquid further comprises an effective amount of at least one bittering agent.

10. The assembly of claim 1, wherein the liquid provides enhanced flame visibility upon combustion, said composition comprising between approximately 65% and 100% by weight of a mixture of alcohols comprising ethanol and isopropanol, wherein isopropanol comprises between approximately 6% and 66% by weight of said composition and ethanol comprises between approximately 34% and 94% by weight of said composition, and wherein the weight ratio of said isopropanol to said ethanol in said composition does not exceed 2:1; and between approximately 0% and 35% by weight of water.

11. The assembly of claim 1, wherein said container is fabricated from at least one thermoplastic resin selected from the group consisting of polyolefins, polyesters, polycarbonates, and combinations thereof.

12. The assembly of claim 1, wherein said container is fabricated from at least one thermoplastic resin selected from the group consisting of polyethylene, polypropylene, polyethylene terephthalate and combinations thereof.

13. The assembly of claim 1, wherein said container measures between 0.5and 3.0 inches in height and between 2 and 8 inches in diameter or width.

14. The assembly of claim 1, wherein said thickness is between approximately 0.010 and 0.040 inches.

15. The assembly of claim 1, wherein said alcohol-based fuel liquid further comprises at least one thickening or gelling agent.

16. The assembly of claim 1, wherein said alcohol-based fuel liquid comprises a thickening or gelling agent in an amount effective to produce an absolute kinematic viscosity at 20.degree. C. of from 250–100,000 cp.

17. The assembly of claim 1, wherein said alcohol-based fuel liquid comprises a thickening or gelling agent present in an amount from 0.1% to 5% by weight of said fuel liquid.

18. The assembly of claim 1, wherein said alcohol-based fuel liquid comprises a thickening or gelling agent present in an amount from 0.2% to 1% by weight of said fuel liquid.

19. The assembly of claim 1, wherein said liquid contains a thickening or gelling agent selected from the group consisting of cellulose derivatives, natural gums, inorganic thickeners, and synthetic homopolymers and copolymers having from 1 to 30 carbon atoms per monomer unit.

20. The assembly of claim 19, wherein said thickening agent is a cellulose derivative selected from the group consisting of hydroxycellulose, hydroxyalkylcellulose, and carboxymethylcelluiose.

21. The assembly of claim 20, wherein said hydroxyalkylcellulose thickening agent is selected from the group consisting of hydroxyethylcellulose, hydroxypropylcellulose, and hydroxypropylmethylcellulose.

22. The assembly of claim 19, wherein said thickening agent is a synthetic homopolymer or copolymer selected from the group consisting of polyacrylic acids, polyacrylic acid esters, polyacrylic acid amides, polymethacrylic acids, polymethacrylic acid esters, polymethacrylic acid amides, polyvinylacetate, and polyvinylpyrrolidone.

23. The assembly of claim 19, wherein said thickening agent is a natural gum selected from the group consisting of acacia, alginate, carrageenan, guar, karaya, pectin, tragacanth, and xanthan.

24. The assembly of claim 19, wherein said thickening agent is an inorganic thickener selected from the group consisting of silicas and clays.

25. The assembly of claim 1, wherein said assembly further comprises an alcohol-impermeable sealing cover film attached to a mouth of the container to form either a hermetic or a removable seal over said container, wherein said sealing cover film, together with said container, prevent leakage and evaporation of said liquid during storage and shipping.

26. The assembly of claim 25, wherein said assembly further comprises a protective overcap lid placed over said sealing cover film and secured to said mouth of said container.

27. The assembly of claim 25, wherein said sealing cover film is selected from the group consisting of induction-sealable thermoplastic films, heat-sealable thermoplastic films, and foil-thermoplastic composite sheets.

28. A method of igniting charcoal and wood fires comprising igniting the fuel in an assembly of claim 1, and allowing said assembly to burn beneath a suitable quantity of charcoal or wood to be ignited for a time sufficient to ignite said quantity of charcoal or wood.

29. The method of claim 28, wherein said assembly further comprises a container sealing sheet, further comprising piercing or otherwise disrupting said container sealing sheet of the container in said assembly prior to igniting said fuel.

30. The method of claim 29 wherein said quantity of charcoal is at least 2 pounds.

31. A kit comprising at least one combustible fire-starting assembly of claim 25, and a quantity of charcoal lumps suitable for preparing a charcoal fire.

32. The kit of claim 31, wherein said quantity of charcoal is at least 2 pounds.

33. The kit of claim 31, further comprising printed instructions for use.

34. A method for heating a material, comprising igniting the fuel in an assembly of claim 1, and allowing said fuel to burn beneath said material.

35. A kit comprising:

(1) a quantity of combustible alcohol-based fuel liquid;

(2) a freestanding, combustible, alcohol-resistant and alcohol-impermeable open plastic container fabricated from at least one plastic resin, wherein said container is substantially free of inorganic materials, and is of a shape which is a member of the group which consists of:

(a) a bowl;

(b) a cup;

(c) a tub; and (d) a dish;

said container having a height, and comprising an opening at a point of maximum width, wherein the maximum width is at least equal to the height, and wherein said container is of a thickness and rigidity as to retain said liquid without leakage throughout the period of combustion, with said container entirely consumed together with the liquid;

(3) an alcohol-impermeable removeable sealing cover film adhesively attached to the opening; and (4) a multiplicity of charcoal lumps suitable for preparing a charcoal fire.

* * * * *